US005784728A

United States Patent [19]

Weddendorf et al.

[11] Patent Number: 5,784,728

[45] Date of Patent: Jul. 28, 1998

[54] PORTABLE BATH BENCH/SEAT

[75] Inventors: Bruce Weddendorf, Decatur; Betty A. Strother, Boaz, both of Ala.

[73] Assignee: Patent/Marketing Concepts, LLC, Boaz, Ala.

[21] Appl. No.: 800,537

[22] Filed: Feb. 18, 1997

[51] Int. Cl.[6] ..... A47K 3/12

[52] U.S. Cl. ..... 4/579; 4/571.1

[58] Field of Search ..... 4/571.1, 573.1, 4/578.1, 579, 559, 560.1–562.1, 605

[56] References Cited

U.S. PATENT DOCUMENTS

| | | | |
|---|---|---|---|
| 1,076,808 | 10/1913 | Arburg . | |
| 2,052,628 | 1/1936 | Higgins . | |
| 2,142,434 | 1/1939 | Bentz . | |
| 2,237,076 | 4/1941 | Kenney et al. | 4/579 |
| 2,664,142 | 2/1953 | Scheuerman et al. . | |
| 3,203,008 | 8/1965 | Murcott | 4/578.1 |
| 3,413,662 | 12/1968 | Stayton . | |
| 4,150,445 | 4/1979 | Bailey . | |
| 4,168,549 | 9/1979 | Davies . | |
| 4,253,203 | 3/1981 | Thomas . | |
| 4,359,791 | 11/1982 | Thomas . | |
| 4,391,006 | 7/1983 | Smith . | |
| 4,472,844 | 9/1984 | Mace . | |
| 4,520,515 | 6/1985 | Hatala . | |
| 4,628,550 | 12/1986 | Walton . | |
| 4,939,799 | 7/1990 | Van Hovel . | |
| 5,168,583 | 12/1992 | Wanke . | |
| 5,263,207 | 11/1993 | Gilbert . | |
| 5,361,428 | 11/1994 | Nanowsky et al. . | |
| 5,365,618 | 11/1994 | Gilbert . | |
| 5,373,591 | 12/1994 | Myers . | |
| 5,606,751 | 3/1997 | Baker . | |

FOREIGN PATENT DOCUMENTS

| | | |
|---|---|---|
| 2056610 | 5/1993 | Canada . |
| 1586660 | 3/1981 | United Kingdom . |

*Primary Examiner*—Charles R. Eloshway
*Attorney, Agent, or Firm*—Dowell & Dowell P.C.

[57] ABSTRACT

A compact and portable bath bench which is mounted on a frame supported by a pair of foldable brackets which engage an outer side wall of a bathtub. The frame is stabilized by a foldable leg assembly which extends from the frame to the bottom of the bathtub. A seat may be supported on the bench by a moveable carriage so that an individual may be seated adjacent the side wall of the bathtub and thereafter moved centrally thereof.

17 Claims, 5 Drawing Sheets

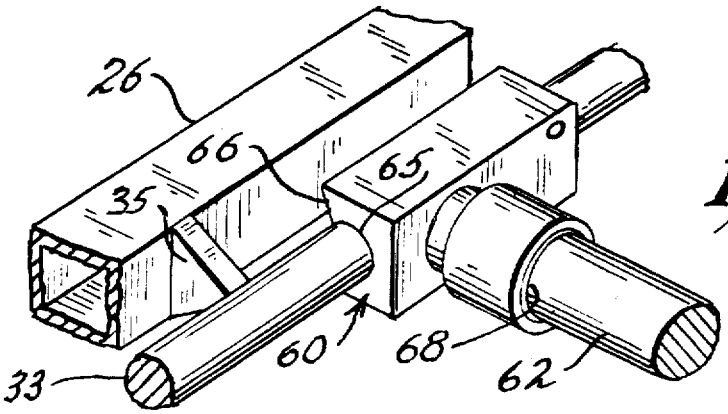
Fig. 7
Fig. 8
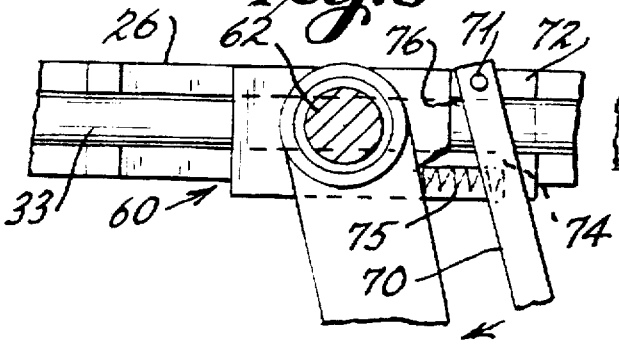
Fig. 9
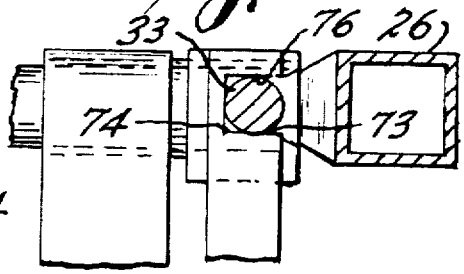
Fig. 10
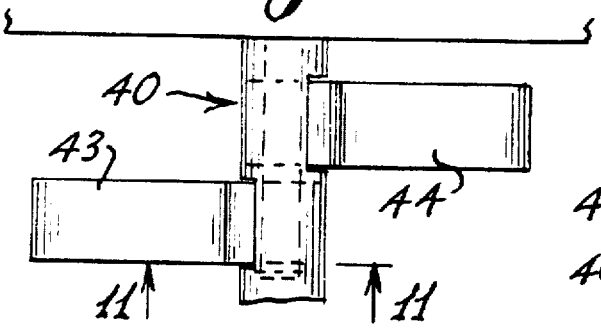
Fig. 11
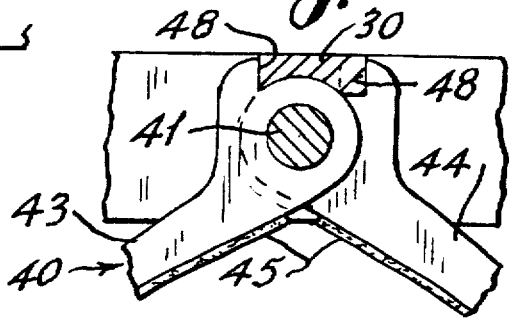
Fig. 12
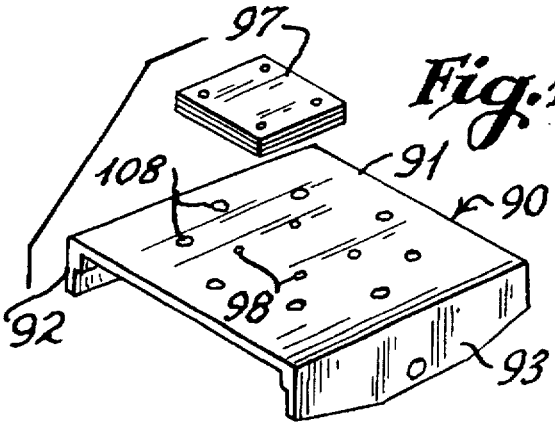
Fig. 13
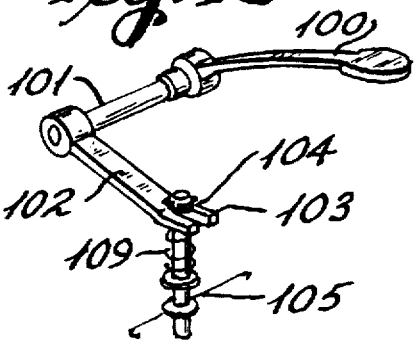

PORTABLE BATH BENCH/SEAT

BACKGROUND OF THE INVENTION

1. Field of the Invention

This invention is generally directed to seating devices for bathtubs and, more particularly, to portable seating devices, which are designed to be mounted to an outer side wall of a bathtub and which include a frame which is cantilevered inwardly of the bathtub which supports a bench to which a seat may be mounted by way of a moveable carriage. The invention is particularly directed to bathtub seating devices which are foldable to facilitate shipping and storage.

2. History of the Related Art

Seating devices have been designed to assist and support individuals within bathtub or shower enclosures. Individuals who are normally confined to wheelchairs or who must use walkers or other assist devices to facilitate their movement cannot enter and exit a bathtub or shower enclosure without assistance and further require support within such enclosures. It often becomes necessary for a caretaker, nurse or family member to exert a great deal of physical effort in order to lift and lower an individual into a bathtub or to lift an individual into a chair positioned within a bathtub or shower enclosure. Prior art seating devices have been designed in order to alleviate this physical effort.

Basic bathtub seating devices often take the form of a bench which is designed to be positioned between the side walls of a bathtub. Often, such benches are supported by a plurality of legs from the bottom of the bathtub. Such benches provide a seating surface on which an individual may be placed either by physically assisting the individual to step within the tub and thereafter be seated on the bench or by physically lifting the individual over the side wall of the bathtub and onto the bench. Some bench-type seats are designed to be more simply supported on the top of the side walls of the bathtub and may include stabilizing devices for engaging the opposite side walls of the bathtub. For example, such a bench is disclosed in U.S. Pat. No. 4,939,799 to Van Hovel. Unfortunately, bench-type seating devices often require an assistant to exert a great deal of physical effort to aid an individual to be seated. However, in those instances where the individual requiring assistance has some measure of physical ability, bench devices may be appropriate and assistance may only be required to stabilize the individual as they step into a bathtub to be seated upon the bench.

To facilitate the manner in which an individual may be positioned on a bath chair or seat, other types of bench supports have been designed to include a portion which is either mounted directly over the outer side wall of the bathtub or cantilevers outwardly therefrom. Such portions provide an initial support for an individual being assisted. By initially seating an individual on a cantilevered seat, the individual may thereafter be moved so that his or her legs are brought inwardly of the bathtub while their weight is supported by the seat, thereafter, the individual may be shifted along the bench within the confines of the bathtub. Examples of this type of bathing support device are disclosed in U.S. Pat. Nos. 4,391,006 to Smith, 4,472,844 to Mace and 4,520,505 to Hatala.

Some types of prior art structures are designed to be permanently installed adjacent the bathtub or shower enclosure. Unfortunately, bulky and permanently fixed structures are often not practical, especially when individuals are traveling, visiting with friends or family or wherein the size of the bathroom does not permit such permanent installations. Examples of this type of bathing chair or support device are disclosed in U.S. Pat. Nos. 1,076,808 to Arborg, 2,052,6298 to Higgins and 5,263,207 to Gilbert.

Other types of portable seating devices have been designed which are supported both along the bottom of a bathtub and by the adjacent floor structure. In U.S. Pat. No. 4,359,791 to Thomas, a slidable seat is disclosed which is mounted on a frame having a pair of legs supported by the bathtub and a pair of legs which are engageable with the floor exteriorly of the bathtub. Unfortunately, the overall structure is not securely positioned relative to the bathtub and can be displaced when in use. Other improvements over this type of seating device have been made wherein a sliding chair is supported directly by the side walls of the bathtub and/or by the adjacent floor structure so as to limit the amount of shifting during use. Although such structures provide greater stability, they often require that a bathtub enclosure have side walls of sufficient size and structure to support the seat. Some examples of this type of bathtub seating device are disclosed in U.S. Pat. Nos. 4,168,549 to Davies, 5,373,591 to Myers and 4,150,445 to Bailey.

In view of the foregoing, there remains a need to provide portable and collapsible bathtub chairs or seats which may be compactly stored for shipment and transportation but which may be easily and readily installed in such a manner as to remain securely in place when an individual is seated thereon. Further, there remains a need to provide portable bathing devices which are convertible in structure to provide for different individual needs and which may be used for substantially any bathtub or shower enclosure having at least one bathtub wall for supporting such devices when in use.

SUMMARY OF THE INVENTION

The present invention is directed to a portable bath bench which may be easily convertible to a portable bath chair and which is designed to be compactly folded for transportation and storage. The invention includes a main frame upon which a bench is mounted. The frame includes pairs of opposing bracket members for engaging an outer side wall of a bathtub or shower enclosure and which are pivotably moveable with respect to the frame. The frame further includes a foldable leg assembly which is moveable along rails provided on the frame and which is utilized to stabilize the frame relative to the bottom wall of a bathtub or shower enclosure in such a manner that the frame is retained horizontally when in use. The foldable leg assembly includes a locking device which allows the angle of the leg assembly to be altered depending upon the depth of the bathtub measured from the upper edge of the side wall.

A seat may be provided which is moveable along the bench by being supported on a carriage having upper and lower sets of rollers which are engageable on the upper and lower surface portions of the bench. The bench may also include molded portions for holding and retaining shampoos, soaps, brushes and related bathing materials at a convenient location for an individual seated either on the seat or on the bench associated with the invention.

It is the primary object of the present invention to provide a lightweight and easily handled bathing device which may be utilized either as a bench or a chair and wherein, when used as a chair, the chair is moveable along the length of the bench from a position adjacent an outer side wall of the bathtub or shower enclosure to a position inwardly thereof so that an individual may be seated on the chair while the seat is adjacent the side wall of the bathtub and thereafter moved inwardly of the bathtub or shower enclosure after which the seat may be locked in a fixed position.

It is a further object of the present invention to provide a bathing apparatus which may be utilized as a bench or chair which is collapsible into a compact configuration for shipment and storage and yet which is easily mounted without the use of tools and without the requirement for providing lockable clamps or other physically adjustable devices to secure the device in place so that the device may be mounted to a single side wall of a bathtub and secured thereto without requiring a significant amount of physical effort.

It is yet a further object of the present invention to provide a portable bathing device which may easily be mounted to a single side wall of a bathtub or shower enclosure and which is retained in a horizontal relationship therewith at all times when an individual is seated thereon.

It is yet a further object of the present invention to provide a portable bathing device which may be utilized as a bench or chair suitable for use with substantially any size of bathtub or shower enclosure and which can be utilized without adversely affecting or damaging the bathtub or shower enclosure adjacent walls, floors and other surfaces.

BRIEF DESCRIPTION OF THE DRAWINGS

FIG. 7 is an enlarged partial view showing a slider assembly associated with the support leg assembly of the present invention;

FIG. 8 is an enlarged cross-sectional view showing a locking device for securing the leg assembly in an adjusted position;

FIG. 9 is a view taken along line 9—9 of FIG. 8;

FIG. 10 is a top plan view of one pair of locking clamps associated with the frame of the present invention;

FIG. 11 is an enlarged cross-sectional view taken along line 11—11 of FIG. 10;

FIG. 12 is an assembly view of the carriage and swivel plate for supporting the seat of the present invention; and FIG. 13 is a perspective view of the locking mechanism associated with the seat of the present invention.

DESCRIPTION OF THE PREFERRED EMBODIMENT

Figure 1:
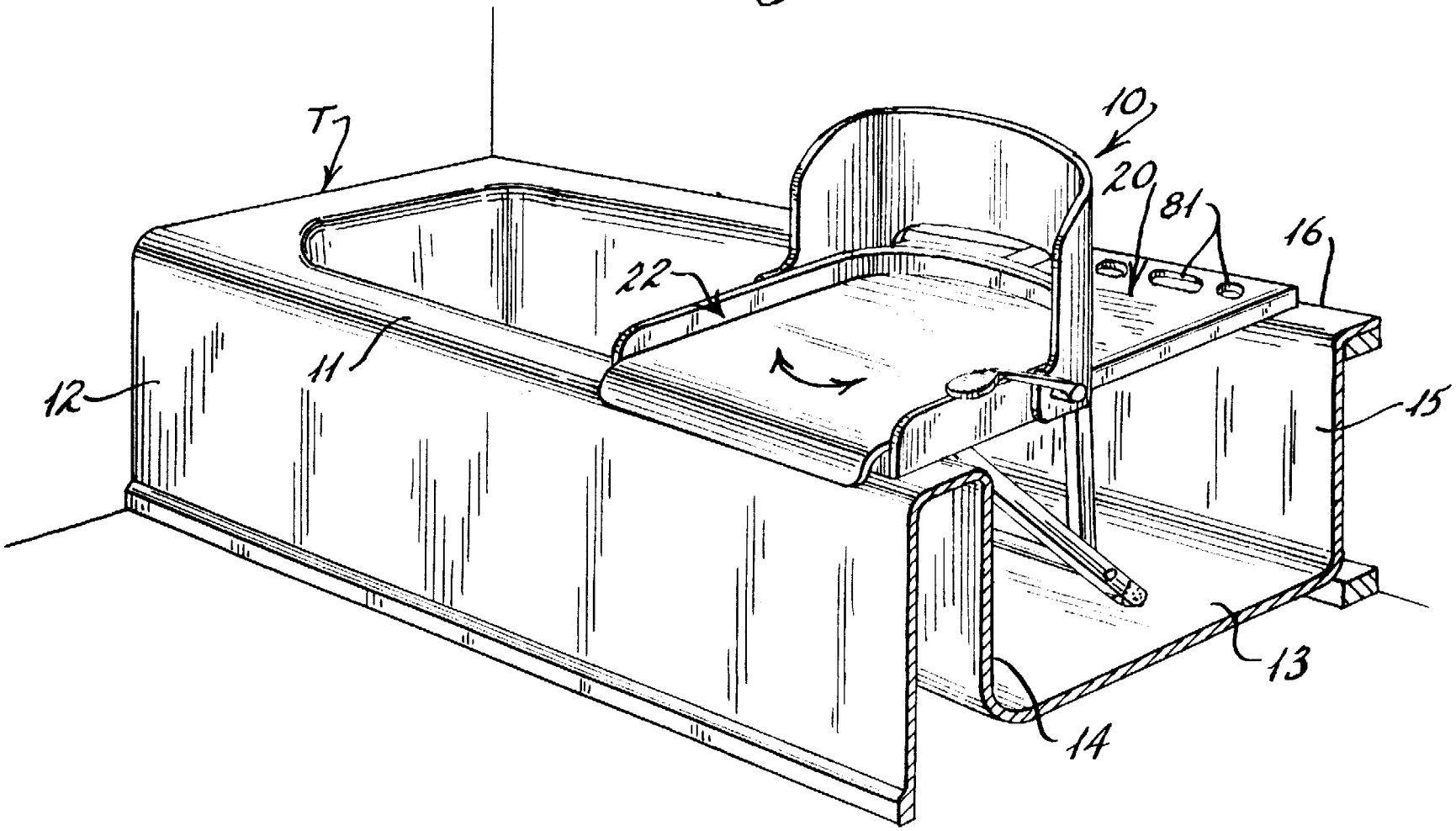
FIG. 1 is a perspective view of the present invention shown mounted to a bathtub wherein a chair is mounted on a finished bench structure associated with the invention.

With continued reference to the drawing figures the portable bath bench/chair 10 of the present is shown in FIG. 1 as being mounted to the upper ledge 11 of the outer side wall 12 of a conventional bathtub "T". The bathtub further includes a bottom wall 13 which extends between an inner outer side wall 14 and an inner wall 15 having an upper ledge 16. The present invention is designed to be utilized as a generally horizontal support and therefore includes a bench 20 upon which an individual may be seated and over which a chair 22 may be slidably and pivotably adjustable so that the chair may be positioned immediately overlying the upper ledge 11 of the outer side wall of the tub or moved inwardly over the central portion of the bench 20 and centrally between the inner side walls 14 and 15 of the bathtub. Although the drawing figures show a bathtub including a inner ledge 16 associated with the inner side wall 15, the present invention is designed to be supported solely by the upper ledge 11 of the outer side wall 12 and by the bottom wall 13 so that the portable bath bench/chair may be utilized on tubs having varying widths as measured between the inner and outer side walls or on tubs or bathing enclosures having no inner ledge associated therewith.

With particular reference with FIGS. 2–6, the bench 20 which is preferably formed of a molded plastic material but may be also formed of a metallic material. The bench is fixedly mounted either by adhesives or suitable fasteners to an underlying frame 25 which includes a pair of elongated side members 26 and 27 which are connected at their outer ends by a first cross member 28 and which are joined at their inner ends by a reinforcing cross member 29. The side members 26 and 27 as well as the outer cross brace 28 are formed of a rectangular cross section metallic stock material, such as aluminum or stainless steel tubing, and are welded to one another. The cross member 29 is shown as being formed as a metallic plate but may also be formed from tubular stock material. The frame is further reinforced by a pair of generally parallel cross members 30 and 31 which are spaced relative to one another adjacent the outer cross member 28 and which are utilized to support clamps and a support leg assembly, as will be discussed in greater detail hereinafter. The frame is further provided with a pair of spaced and generally parallel guide rails 33 and 34 which are connected by spacers 35 and 36 to the longitudinal frame members 26 and 27, respectively. The outer end of each of the rails 33 and 34 is welded to a cross brace 37 extending between and insertably connected or welded to the longitudinal members 26 and 27.

To engage the frame to the upper ledge 11 of the outer side wall 12 of the bathtub, a pair of clamp assemblies 40 are mounted to stub shafts 41 and 42 connected to the cross member 30. Each clamp assembly includes a pair of opposing clamp arms 43 and 44 which have somewhat concave lower surfaces which are preferably covered with resilient pads 45 formed from a rubber or foam material having a high coefficient of friction for engaging the upper edges of the ledge 11 of the outer side wall 12 of the bathtub to prevent both the shifting of the clamping arms relative thereto as well as to protect the finish of the outer side wall of the bathtub.

Figure 5:
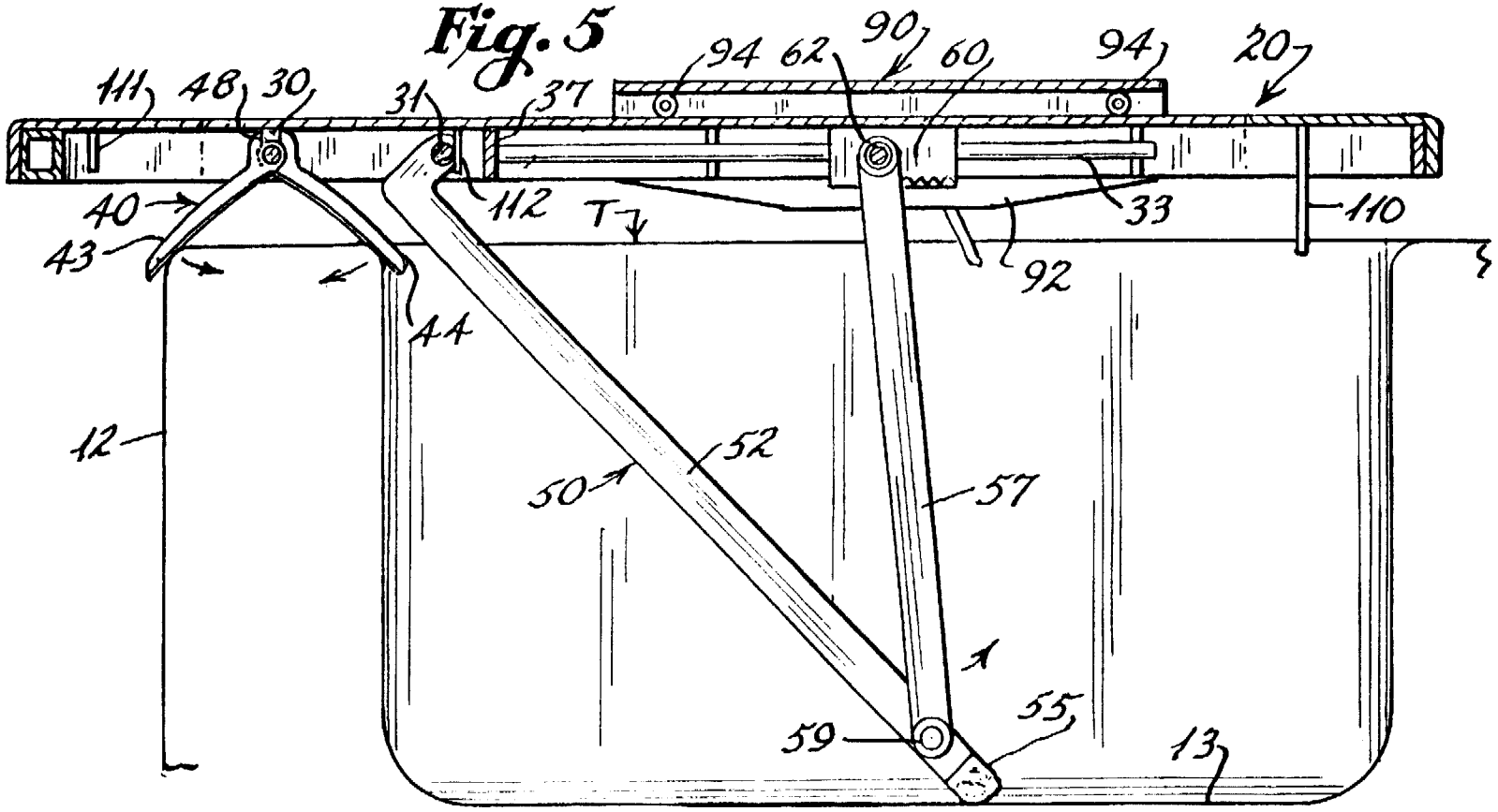
FIG. 5 is a cross-sectional view similar to FIG. 2 showing the bench utilized with a moveable carriage and seat.
Figure 6:
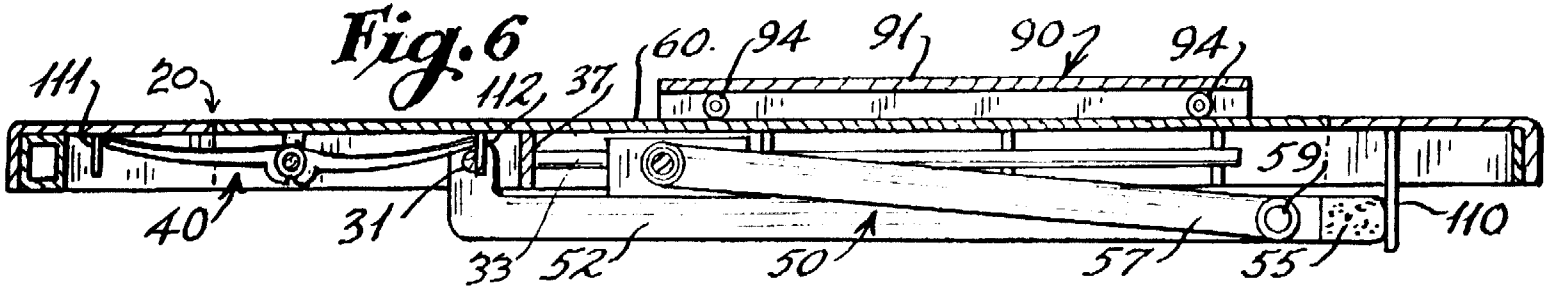
FIG. 6 is a cross-sectional view similar to FIG. 5 showing the bathing bench folded into a compact storage configuration.

With particular reference to FIGS. 5 and 6, the arms 43 and 44 of each clamp assembly are pivotably mounted at the inner ends about the rod or stub shafts 41 and 42 carried by the cross member 30 so that they may be pivoted away from one another so as to cooperatively engage the upper ledge of a bathtub regardless of the width of the outer wall of the bathtub. The arms may also be pivoted to a fully stored position outwardly relative to one another as shown in FIG. 6. Bushings or bearings (not shown) may be provided between the inner portion of each of the arms 43 and 44 and the stub shafts 41 and 42 to facilitate pivotable movement of the arms relative thereto. The inner portion of the arms further include opposing abutment portions 48 which are engageable with the cross member 30 when in the fully open position, shown in FIG. 5. By moving the arms 43 and 44 toward one another as shown by the arrows in FIG. 5 when the frame has been lifted from the side wall of a bathtub, the arms will pivot fully around so as to come into the storage position, shown in FIG. 6. Although, not shown in the drawings, suitable spring elements may be provided for biasing the arms 43 and 44 toward the stored position of FIG. 6 so that they automatically assume a stored position whenever the frame is lifted from the side wall of the bathtub.

Figure 3:
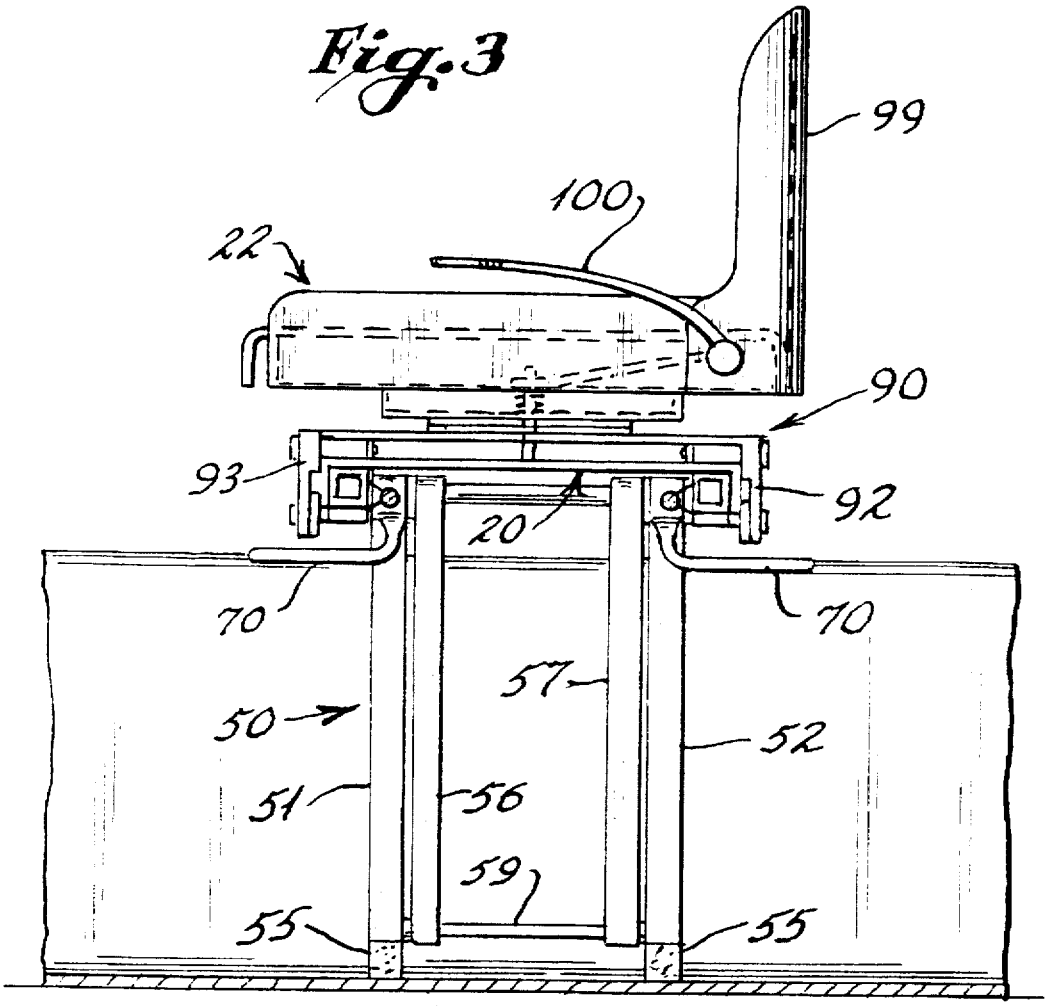
FIG. 3 is a view taken along line 3—3 of FIG. 2.
Figure 4:
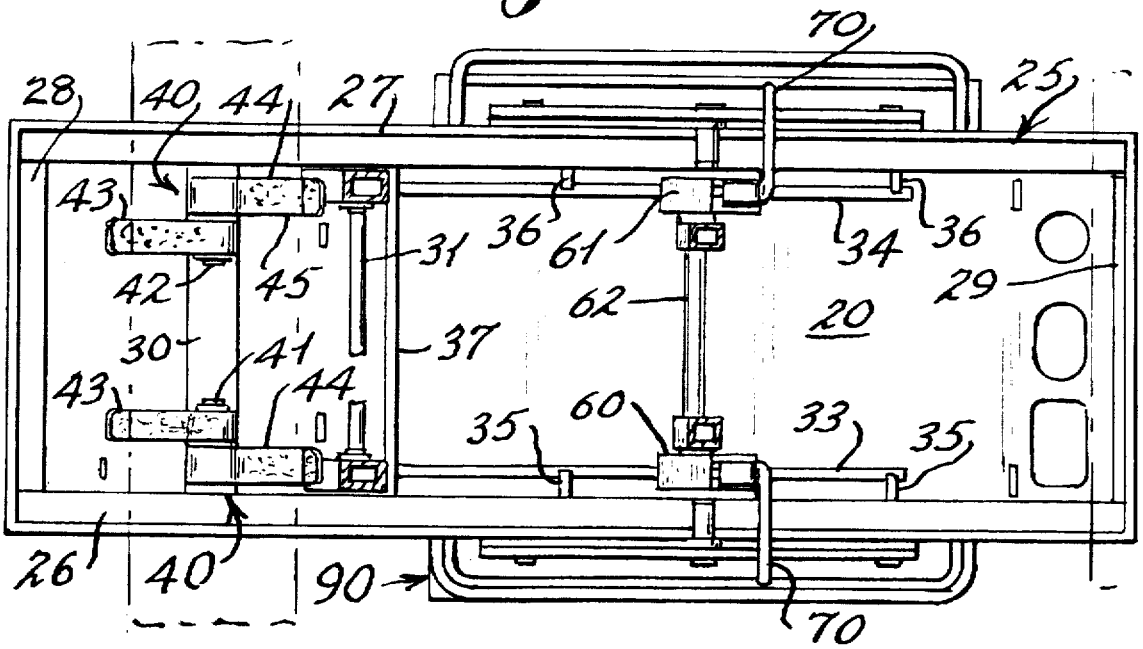
FIG. 4 is a bottom view taken along line 4—4 of FIG. 2.

To further support the remaining portion of the frame within the bathtub enclosure, and as shown in FIGS. 4–6, a leg assembly 50 is provided. The leg assembly 50 includes a pair of parallel legs 51 and 52 having upper generally "L" shaped ends having openings allowing the legs to be pivotably mounted to the cross brace rod 31. Suitable bearings (not shown) may also be provided between the openings in the legs and the rod 31. The lower end of each of the legs includes a rubber boot or foot 55 for frictionally engaging the lower wall 13 of a bathtub. The legs 51 and 52 are reinforced by a pair of vertically pivotable struts 56 and 57 which are pivotably connected at their lower ends to a cross brace 59 extending between and connecting the lower portions of the legs 51 and 52 and the struts 56 and 57, as shown in FIG. 3. The upper portion of each of the struts are pivotably connected to separate guide blocks 60 and 61 slidably mounted to the opposing rails 33 and 34 associated with the frame 25. The guide blocks are connected by a cross brace 62 in the form of a rod extending therebetween which ensures that the blocks move simultaneously along the rails 33 and 34. Each block includes a generally "C" shaped longitudinal slot 65, FIG. 7, in the outer face thereof which engages one of the rails 33 or 34. The outer face of each block is also tapered as shown at 66 for purposes of preventing interference of the blocks with the connectors 35 and 36 mounting the rails 33 and 34 to the main frame. The upper ends of each of the struts 56 and 57 are pivotably connected to the cross member 62 by way of suitable bushings 68, such as shown in FIG. 7.

With particular reference to FIGS. 8 and 9, each of the guide blocks 60 and 61 is designed to be locked with respect to the rails 33 and 34 by way of locking mechanisms carried by each block. Each locking mechanism includes an actuating lever 70 which is pivotably mounted at 71 to the blocks 60 and 61 and within suitable openings 72 provided at one end thereof. Adjacent the upper end of the lever 70, a cut-out 73 is provided through which the respective rails 33 and 34 extend. Each cut-out includes a lower locking edge 74 which is normally urged into tight engagement with the bottom of the respective rods 33 and 34 by way of a spring 75 mounted to each block. The cut-out also includes an upper edge 76 which binds with the upper portion of each of the rails 33 and 34 when the levers 70 are in a fully locked position, as shown in FIG. 8. By pivoting the levers in the direction of the arrow shown in FIG. 8 to compress the spring 75, the slotted opening 73 is aligned with the respective rails 33 and 34, thereby allowing movement of the blocks relative to the rails. Upon release of the levers 70, the springs 75 automatically cause the notch portions 73 of each lever or handle to bite against the upper and lower portions of the rails, thereby preventing any further movement of the blocks 60 and 61 relative thereto.

The extent of the movement of the blocks 60 and 61 along the rails 33 and 34 will depend upon the height of the upper ledge 11 of the bathtub relative to the lower wall 13 thereof. In use, the leg assembly is pivoted downwardly, thereby moving the block assemblies away from the side wall 12 of the bathtub. Once the boots 55 of each of the legs 51 and 52 engage the bottom wall 13 of the tub, the locking levers are released thereby immediately preventing any further movement of the blocks 60 and 61 relative to the rails and maintaining the legs 51 and 52 in contact with the bottom wall of the bathtub.

When the invention is to be removed from a bath enclosure, the lever 70 associated with the blocks 60 and 61 is engaged and urged toward the springs associated therewith and thereafter the legs 51 and 52 are pivoted upwardly, as shown by the arrows in FIG. 5, into a collapsed engagement beneath the bench 20 and beneath the frame, as shown in FIG. 6. In this configuration, the invention is compact and may be easily stored in a suitable closet or other space.

Figure 2:
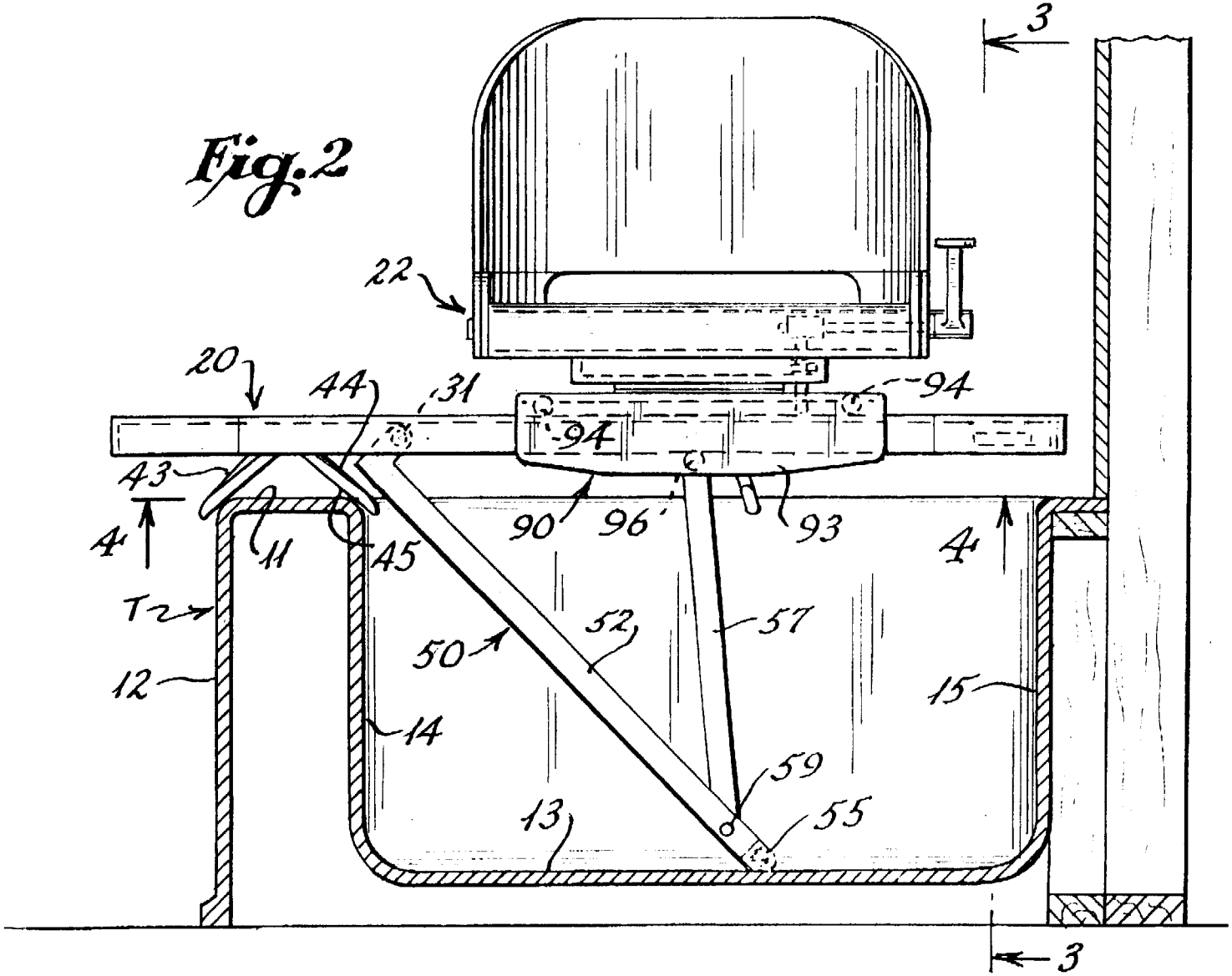
FIG. 2 is a left side view of the embodiment shown in FIG. 1 showing the chair being rotated from the position shown in FIG. 1 and also being moved inwardly between the side walls of the bathtub.

As previously noted, the present invention may be utilized solely with the bench 20 mounted on the frame 25. Further, the bench may be provided with molded apertures such as shown at 81 for purposes of facilitating support of bathing devices, including shampoos, soaps and other containers. The present invention may also be utilized with a movable seat 22. With particular reference to FIGS. 1, 5, 12, and 13, the seat 22 is mounted upon a carriage 90 having an upper generally horizontal platform 91 of a size to extend across the width of the bench and having depending side flange portions 92 and 93 which extend on opposite sides of the bench. The platform is supported in rolling engagement with the upper surface of the bench, as shown in FIG. 5 by pairs of plastic rollers 94 which are mounted to spaced stub shafts mounted through the side flanges 92 and 93 thereof. The carriage is locked relative to the bench by providing lower rollers 96 which are mounted to stub shafts along the lower portion thereof and on each of the depending slide flanges 92 and 93. As shown in FIG. 2, the carriages are rollingly engaged with the bench by having two sets of upper rollers 94 and a single set of spaced lower rollers 96 which engage along the upper surface and along the lower outer edges of the bench, respectively.

The seat 22 is mounted by suitable fasteners to a pivot plate or base 97 which is mounted to suitable openings 98 provided in the support platform 91 in such a manner that the seat may be pivoted, as shown by the arrow in FIG. 1, so that the seat may be oriented outwardly of the side wall 12 of the bathtub to allow a person to be comfortably seated on the seat and thereafter the seat pivoted into general alignment with the length of the tub, as shown in FIG. 3. In the preferred embodiment, the seat also includes a pivotable back rest 99 which can be folded onto the seat 22 for purposes of compact storage.

As shown in FIGS. 3 and 13, the seat further includes a locking assembly including an operating handle 100 which is connected to a pivot shaft 101 fixedly mounted to a rocker arm 102 mounted to the lower portion of the seat 22. The rocker arm 102 includes a bifurcated end portion 103 which engages a collar 104 mounted to a locking pin 105 which is mounted within one of a plurality of spaced openings 108 provided in symmetrical relationship and spaced with one another about a central point of the plate 91 of the carriage 90. A spring element 109 normally urges the locking pin 105 into a lower position in which it is engageable within one of the openings 108. By raising the handle 100, the rocker lever 102 is elevated thereby raising the locking pin 105 from one of the openings 108 against the spring 109 until another opening 108 is aligned with the locking pin 105 afterwhich the handle may be released allowing the locking pin 105 to engage within one of the openings 108 to prevent further rotation of the seat relative to the bench.

As previously discussed, the present invention is designed to be collapsible for storage and/or shipment. In this respect, a first retention flange 110 may be molded adjacent the lower portion of the bench adjacent the second end of the frame at a position so as to frictionally engage the lower end or boot portion 55 of at least one of the leg members as they are raised into generally parallel relationship beneath the bench, as shown in FIG. 6. A second pair of spaced retention means 111 and 112 are molded and extend from the bottom portion of the bench adjacent the first end of the frame on either side of the clamp assemblies 40. The second retention members 111 and 112 are spaced so as to frictionally engage the outermost ends of each of the arms 43 and 44 of the assemblies when the arms are pivoted outwardly, as shown in FIG. 6 of the drawings, to frictionally retain the arms in a position beneath the bench, as shown in the drawing figures.

Outward movement of the seat relative to the bench 20 and the frame 25 is prevented by providing suitable stops (not shown) molded along the inner portion of each of the side walls of the bench adjacent the outer portion thereof which are engageable with the stabilizing rollers 94 associated with the seat carriage.

In use, when it is desired for the bench or chair to be utilized, the clamp assemblies 40 are first engaged with the upper edge of an outer side wall of a bathtub, as shown in FIG. 2, by pivoting the legs away from one another and extending them from beneath the bench 20. Depending upon the width of the side wall of the bathtub, the point of contact with the arms 43 and 44 of the clamp assemblies will vary. Thereafter, the locking lever 70 of each of the blocks 60 and 61 associated with the leg assembly 50 are urged against their respective springs thereby unlocking the blocks from the rails 33 and 34. The legs and struts 51, 52 and 56 and 57 are thereafter lowered into a position wherein the foot portion 55 of each of the legs engages the bottom wall of the tub in such a manner that the bench 20 is oriented horizontally and in parallel relationship with respect to the bottom wall 13 of the tub. Thereafter, locking levers 70 are released thereby locking the leg assembly in position.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A portable bath chair apparatus for use with a bathtub having an outer wall defining an upper ledge and a bottom wall, the portable bath chair apparatus comprising, a main frame having a pair of elongated side members, a bench having upper and lower portions, said lower portion of said bench being slidably mounted to said main frame for longitudinal movement therealong so that said bench overlies said main frame and said main frame having a first end adapted for extending over the upper ledge of the bathtub and a second end adapted for extending inwardly of the bathtub, at least one clamp assembly mounted adjacent said first end of said main frame, said first clamp assembly including opposing arm portions adapted to engage the upper ledge of the outer wall of the bathtub, a leg assembly including a pair of spaced leg members having first ends pivotally mounted to said main frame and second ends adapted to selectively engage the bottom wall of the bathtub, and strut members having first ends pivotally mounted to said leg members and second ends pivotally mounted to means for sliding, means for connecting said means for sliding to said main frame so as to be moveable longitudinally in generally parallel relationship with respect to said side members of said main frame, and locking means for locking said slide means in fixed relationship with respect to said main frame.

2. The portable bath chair apparatus of claim 1 including a seat and carriage means mounted to said bench for adjustably supporting said chair relative to said bench.

3. The portable bath chair apparatus of claim 2 in which said carriage means includes an upper portion and a pair of depending side walls, first and second roller means mounted to each of said depending side walls of said carriage means for engaging said bench therebetween.

4. The portable bath chair apparatus of claim 3 in which said first roller means includes at least two rollers mounted in spaced relationship adjacent said upper portion of said carriage means and said second roller means includes at least one roller mounted to each of said depending side walls of said carriage means adjacent a lower portion of each said depending side wall, whereby said upper rollers engage said upper surface of said bench and said lower rollers engage said lower portion of said bench.

5. The portable bath chair apparatus of claim 4 including a swivel mount secured to said upper surface of said carriage means, and means for connecting said seat to said swivel mount.

6. The portable bath chair apparatus of claim 5 including locking means for locking said seat in a selected angular relationship with respect to said upper surface of said carriage means.

7. The portable bath chair apparatus of claim 6 including a plurality of openings in said upper surface of said carriage means, said locking means including a rod selectively extendable through said openings in said upper surface of said carriage means, a handle extending outwardly from said seat, means for connecting said handle to said rod, and resilient means for normally urging said rod through one of said openings in said upper surface of said carriage means.

8. The portable bath chair apparatus of claim 2 including a pair of generally parallel side rails mounted to said side members of said main frame, said means for sliding including a pair of slide members each having a block element having a groove formed therein for cooperatively receiving one of said side rails therein, whereby said slide members are moveable along at least a portion of the length of said side rails.

9. The portable bath chair apparatus of claim 8 wherein said locking means includes a lever pivotally mounted within an opening in each of said block elements, each of said levers including a notch portion therein defined by upper and lower surfaces, and resilient means normally urging said upper and lower surfaces defining said notch into engagement with one of said side rails to thereby retain said block elements in fixed relationship with respect thereto.

10. The portable bath chair apparatus of claim 9 wherein each of said opposing arm portions of said at least one clamp assembly includes a generally concave bottom surface portion, and padding means covering said concave bottom surface portions of said opposing arm portions.

11. The portable bath chair apparatus of claim 10 wherein said opposing arm portions are pivotally mounted to said main frame, whereby said opposing arm portions may be pivoted to a position immediately beneath said bench.

12. The portable bath chair apparatus of claim 11 including means for limiting the pivotable movement of said opposing arm portions outwardly with respect to one another when pivoted in opposing directions.

13. The portable bath chair apparatus of claim 12 including a first pair of retention means mounted to said lower portion of said bench and extending downwardly with respect thereto, said first pair of retention means being spaced so as to engage said second end of at least one of said leg members when said leg members are pivoted into a generally parallel relationship with, and beneath, said bench.

14. The portable bath chair apparatus of claim 13 including a second pair of retention means mounted in spaced relationship adjacent a first end of said bench and extending from said lower portion thereof, said second pair of retention means being spaced so as to frictionally engage outer end portions of each of said opposing arm portions when said opposing arm portions of said at least one clamp are pivoted beneath said bench.

15. The portable bath chair apparatus of claim 12 including a pair of clamp assemblies pivotally mounted to said main frame in spaced relationship with respect to one another.

16. The portable bath chair apparatus of claim 1 wherein said bench includes a plurality of recesses in which materials may be selectively stored.

17. The portable bath chair apparatus of claim 1 including a resilient boot mounted to each of said second ends of said leg members.

* * * * *